US007165825B2

(12) United States Patent
Michele et al.

(10) Patent No.: US 7,165,825 B2
(45) Date of Patent: Jan. 23, 2007

(54) PROCESS AND DEVICE FOR CLEANING AN INKJET PRINTING HEAD

(75) Inventors: Helmut Michele, Castrop-Rauxel (DE); Dirk Klein, Hagen (DE); Peter Busch, Bochum (DE); Eugene Harazim, Dortmund (DE)

(73) Assignee: Artech GmbH design + production in plastic, Dortmund (DE)

( * ) Notice: Subject to any disclaimer, the term of this patent is extended or adjusted under 35 U.S.C. 154(b) by 379 days.

(21) Appl. No.: 10/772,300

(22) Filed: Feb. 6, 2004

(65) Prior Publication Data

US 2004/0155919 A1 Aug. 12, 2004

(30) Foreign Application Priority Data

Feb. 6, 2003 (DE) ..... 103 04 964

(51) Int. Cl.
*B41J 2/165* (2006.01)

(52) U.S. Cl. ..... 347/28; 347/23

(58) Field of Classification Search ..... 347/22–36
See application file for complete search history.

(56) References Cited

U.S. PATENT DOCUMENTS

| | | | | |
|---|---|---|---|---|
| 5,541,628 | A * | 7/1996 | Chang et al. | 347/10 |
| 6,305,778 | B1 * | 10/2001 | Kobayashi et al. | 347/30 |
| 6,779,860 | B1 * | 8/2004 | Hara et al. | 347/9 |
| 2002/0163556 | A1 * | 11/2002 | Premnath et al. | 347/35 |
| 2003/0011656 | A1 * | 1/2003 | Caren et al. | 347/28 |

* cited by examiner

*Primary Examiner*—Stephen Meier
*Assistant Examiner*—Ly T Tran
(74) *Attorney, Agent, or Firm*—Hoffman, Wasson & Gitler, P.C.

(57) ABSTRACT

This invention relates to a process for cleaning an inkjet printing head which has nozzle openings and ink channels which lead to them, in which electrical drive elements for ejecting ink out of the nozzle openings are located, in which the nozzle openings and the ink channels are forcibly flushed with cleaning liquid. To achieve improved cleaning action more gently and less expensively, the drive elements are triggered in an oscillating manner during the forced flushing with cleaning liquid. A cleaning device for carrying out this process is also disclosed.

14 Claims, 2 Drawing Sheets

PROCESS AND DEVICE FOR CLEANING AN INKJET PRINTING HEAD

BACKGROUND OF THE INVENTION

The invention relates to a process for cleaning an inkjet printing head which has nozzle openings and ink channels which lead to them, in which electrical drive elements for ejecting ink out of the nozzle openings are located, in which the nozzle openings and the ink channels are forcibly flushed with cleaning liquid. A device according to this process for cleaning an inkjet printing head with a holding device for the printing head, connecting means for liquid-tight coupling of a detergent line to the nozzle openings of a printing head inserted into the holding device, and a flushing device for delivering the cleaning liquid to the detergent line is likewise the subject matter of the invention.

Designs of inkjet printers are known in which the inkjet printing heads are each nondetachably connected by an ink tank to an ink cartridge with an integrated printing head. The printer manufacturers design these ink cartridges as disposable products which are to be replaced by filled new products as soon as the ink reservoir in the ink tank has been used up.

Over time, in the nozzle openings and in the fine ink channels which lead to them deposits and contaminants can collect, for example due to dried ink residues. These contaminants can constrict or block the ink channel in the printing head or the nozzle openings so that individual nozzles no longer work properly or can fail and the print image is adversely affected. If, as intended by the printer manufacturers, a new printing head is used with each ink refill, these adverse effects are largely prevented. In any case the frequent replacement of high quality printing heads entails a considerable production expense and causes high costs which are passed on to the final consumer by the manufacturer. In addition the environment is also burdened by the discarded printing heads.

For these reasons it is a good idea to reprocess used ink cartridges for re-use. The reprocessing comprises refilling of the ink cartridge with new ink and reconditioning of the printing head which is ensured essentially by thorough removal of all contaminants. Because the possible ink throughput of the printing heads is a multiple of the charge of the ink cartridge, these refill products are generally qualitatively equivalent to the new products.

The quality of the refill products depends directly on the fact that the printing heads are cleaned to be as free of residue as possible without wearing or damaging the fine structures of the ink channels and nozzle openings. To do this, forced flushing has long been used, in which cleaning liquid is flushed under pressure from the outside through the nozzle openings, therefore against the flow direction of the ink in printing operation ("reverse flushing"). In this way it is possible to remove even sticking foreign bodies to the inside from the nozzle openings which generally run conically to the outside.

The cleaning action by simple flushing processes is however limited by the fact that the nozzle openings are fluidically connected to one another during flushing so that only a relatively low overpressure can build up in front of a constricted or blocked cross section. If the overpressure is not enough to detach and wash away the contaminant, satisfactory cleaning is not possible and the pertinent printing head is ultimately unusable.

To improve the cleaning action, EP 1 101 616 A1 has already proposed exciting the printing head from the outside with ultrasound during flushing, similarly to the known ultrasonic cleaning baths. But it has been found in practice that the nozzle plates of the printing heads, which plates are provided with nozzle openings, and to some extent the drive elements—heating elements or piezo-oscillators—are damaged. With external excitation with high energy ultrasound harmful resonance peaks can occur. In any case improvement of cleaning by exposure to sonic waves from the outside cannot be achieved. In addition the integration of an ultrasonic means into the flushing means is relatively complex.

In view of the above described problem, an objective of the invention is to devise a process which has improved cleaning action compared to simple forced flushing, however is more gentle and less complex than the known ultrasonic cleaning processes. A device for carrying out the process will likewise be devised.

SUMMARY OF THE INVENTION

Proceeding from the known processes with the initially mentioned features, it is proposed as detailed in the invention, that the drive elements are triggered in an oscillating manner during the forced flushing with cleaning liquid.

One particular of the process is that simultaneously with flow through the nozzle openings and the ink channels, the drive elements are actuated. To do this, the drive elements of the printing head—in thermal inject printers they are electrical heating resistors, in piezo printers, piezoelectric actuators—are triggered by an electrical alternating or pulsed voltage. In this way, in the area of the ink channels in front of the nozzle openings in the through-flowing cleaning liquid, pressure waves are excited, as lead to ejection of ink drops from the nozzle openings in normal operation of the printer. During the cleaning process as detailed in the invention, the flow pressure by forced flushing is superimposed on periodic pressure fluctuations.

One advantage of the process is that forces which are greater in the amplitude peaks of the pressure waves than the maximum possible flow pressure by forced flushing are applied to deposits and contaminants in the nozzle openings and the ink channels. Even stubborn contaminants are reliably detached by the oscillating pressure waves and pulses and flushed away with the cleaning liquid. In particular ink deposits adhering to the heating resistors of thermal inkjet printing heads are reliably removed.

Another advantage is that the process works gently. In contrast to known cleaning processes with ultrasonic injection, no uncontrolled resonances occur so that damage to the filigree structures of the nozzle plate with the nozzle openings and the ink channels is largely precluded.

Last, but not least, the process can be carried out with low cost. Compared to a simple flushing process, only one alternating voltage source which is connected to the electrical operating terminals of the printing head is necessary. Practical implementation in any case is much simpler than if an external ultrasonic cleaning means had to be made available, as known in the prior art.

In the implementation of the process, it can be provided that some of the majority of drive elements present in the printing head are triggered at one time. Inkjet printing heads as in the prior art for each ink color have in part up to several hundred nozzles. Because during the forced flushing only individual drive elements or groups of drive elements which are connected to one supply line in the printing head are actuated at one time, selective cleaning can take place, and the energy can be injected locally concentrated.

The cleaning action by the above described selective triggering can be further enhanced by operating individual drive elements or groups of drive elements phase-shifted with alternating voltage. By superimposing amplitude peaks locally stronger pressure pulses can be produced in the cleaning liquid, by which larger forces can be applied to foreign bodies and contaminants.

Alternatively it is possible to trigger all the drive elements of a printing head at the same time. This type of triggering can be easily done and enables short cleaning cycles by the parallel cleaning of all nozzle openings and ink channels.

It is especially advantageous for the flow of cleaning liquid in forced flushing to be directed from the outside of the nozzle openings to the inside through the ink channels. The cleaning liquid is pumped from the outside by the printing head. Due to the flow direction which is reversed to printing operation of the printing head, this process is called reverse flushing. The combination of reverse flushing with the triggering of the drive elements is especially effective in that the forces are applied to deposits and blockages in the opposite direction by the flushing flow and the oscillation of the drive elements, especially in the area of the nozzle openings. There, according to experience, especially stubborn contaminants which must be removed as completely as possible to ensure print quality are formed by dried ink. Because the nozzle openings converge conically constricted from the inside to the outside, the foreign bodies sticking in them are reliably forced out to the inside by the reverse flushing as claimed in the invention.

Alternatively it is likewise possible for the flow of cleaning liquid in forced flushing to be directed from the inside through the ink channels through the nozzle openings to the outside. The forced flushing here has the same flow direction as the ink flow in the operation of the printing head. Pressure pulses in the flow direction are superimposed on the triggering of the drive elements as claimed in the invention so that the ink flow path is freely flushed.

Preferably the flow direction of forced flushing is reversed at least once during cleaning. In this way the cleaning action is improved. Moreover this process is feasible for reprocessing of ink cartridges with an ink tank and permanently integrated printing head. During the reverse flushing the ink tank is filled from the outside with cleaning liquid by the printing head; after reversal of the flushing direction, for example by applying an negative pressure from the outside to the nozzle openings, the ink tank is sucked empty again. Then refilling with ink can be done.

The drive elements are preferably triggered essentially with the operating frequency and/or amplitude of the printing head in printing operation of an inkjet printer. This ensures that on the one hand the drive elements are not electrically overloaded and on the other hand no harmful pressure peaks and resonances are produced. In practice the drive elements can be triggered with a frequency from roughly 5 to 20 kHz.

The cleaning liquid should be a liquid which has physical properties similar to the ink used in the printing head. With respect to the availability and applicability of the cleaning result to real printing operation of the printing head it is a good idea for ink to be used as the cleaning liquid. In the simplest case the same colored ink with which the ink tank of an ink cartridge is then to be refilled can be used. Alternatively a cleaning liquid can be used which in its composition corresponds essentially to a colored ink, in contrast however does not contain coloring substances, so-called colorless ink. Optionally in place of the dyes or pigments detergent substances, solvents or the like can be added.

One advantageous extension of the process calls for measuring the electrical operating parameters of the drive elements during triggering. The drive elements are triggered by connection to an electrical alternating voltage source, each type of drive element being distinguished by characteristic operating parameters, for example, power consumption or phase shift. Deviations from the given reference values generally indicate a defect. Because during the implementation of the process as claimed in the invention these operating parameters are measured and compared to reference values, a meaningful function test in the same operation is possible. If a defect is ascertained, the ink cartridge can be sorted out before it is refilled.

The invention furthermore relates to a device for cleaning an inkjet printing head with a holding device for the printing head, connecting means for liquid-tight coupling of a detergent line to the nozzle openings of a printing head which has been inserted into the holding device, and a flushing device for supply of the cleaning liquid to the detergent line.

These devices are known, and generally an ink cartridge with an integrated printing head can be inserted into the holding device for the printing head for processing by means of forced flushing.

To carry out the process, in a device as detailed in the invention, it is proposed that the holding device has electrical contact elements which can be connected to an electrical trigger device and can make contact with electrical operating terminals of a printing head which has been inserted into the holding device.

While the flushing device can be connected to the nozzle opening of the printing head and flushing or reverse flushing can be done by printing or suction operation, electrical connection of the printing head to a trigger generator for the drive elements takes place via electrical contact elements. In this way the drive elements can be activated at the same time with forced flushing.

The trigger device can be an external signal generator which delivers electrical pulses to the drive elements which correspond essentially to printing operating. One especially simple and pragmatic approach calls for a printer to be used as the trigger generator for the cleaning device as claimed in the invention, from which printer the trigger signals for the printing head are tapped. This ensures that the printing head is also triggered in the optimum range during cleaning—identically to actual printing operation. Moreover a cleaning device can be converted by the corresponding adaptation of a new printer at low cost for processing of ink cartridges for this new type of printer.

BRIEF DESCRIPTION OF THE DRAWINGS

One embodiment of the device as claimed in the invention is detailed below using the drawings:

DETAILED DESCRIPTION OF THE INVENTION

Figure 1:
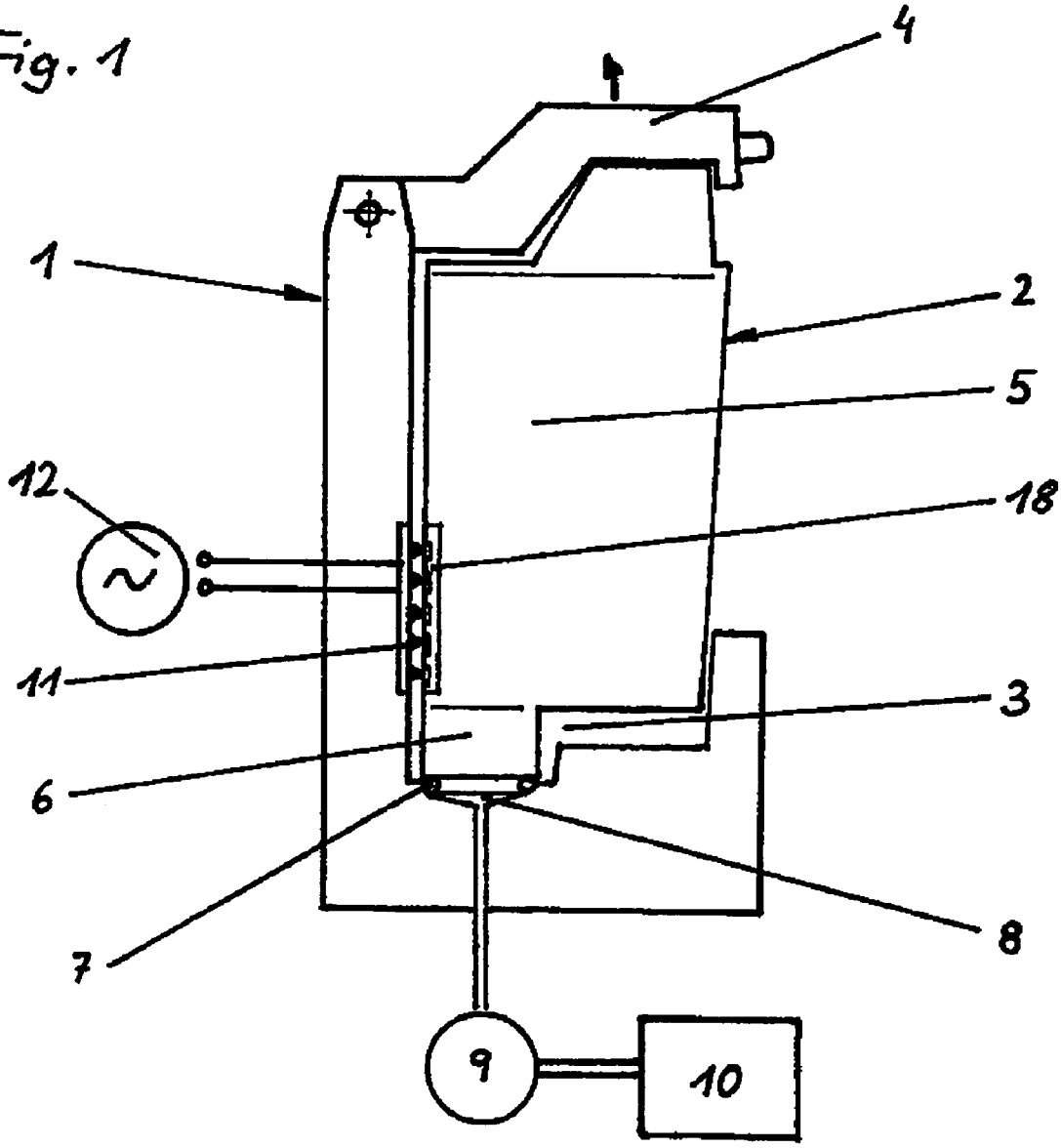
FIG. 1 shows a side view of the device as claimed in the invention (schematic)

FIG. 1 shows in a side view a cleaning device 1 into which an ink cartridge 2 inserted is shown. The wall of the device 1 facing the viewer is omitted for clarity.

The device 1 has a holding device 3 into which the ink cartridge 2 can be inserted. For easy insertion and removal the cover 4 can be folded up, as shown by the arrow, and in the closed position locked or latched for fixing the ink cartridge 2.

The ink cartridge 2 is formed essentially from an ink tank 5 to which the printing head 6 is securely attached. On the inside of the ink cartridge 2 which is at left in this view there are electrical operating contacts 18 which are internally connected to the printing head 6.

The printing head 6 in the inserted state of the ink cartridge 2 sealed liquid tight by a seal 7 adjoins the connecting opening 8. This connecting opening 8 is connected to a pump means 9 which for its part is connected to a detergent tank 10.

The cleaning device 1 has electrical contact elements 11 which are located in the holding device 3 and which are connected to an electrical trigger device 12. The contact elements 11 electrically conductively adjoin the operating contacts 18 of the inserted ink cartridge 2.

Figure 2:
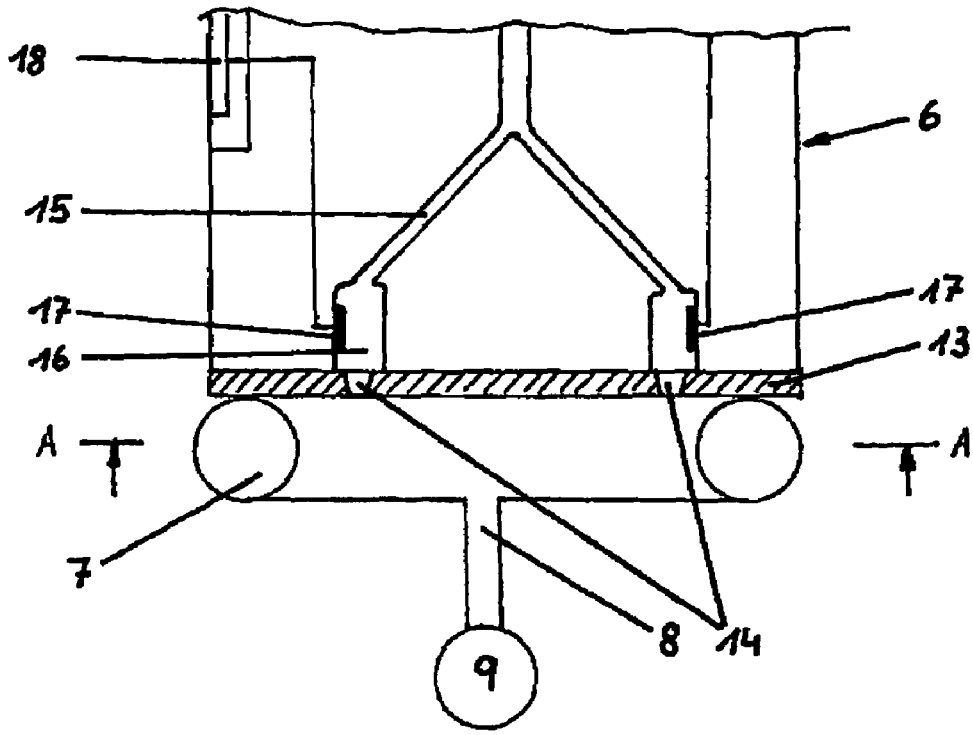
FIG. 2 shows an enlarged partial view of the device as shown in FIG. 1 in a section.

FIG. 2 shows enlarged a sectional view of the printing head 6. A nozzle plate 13 is clearly recognizable and has nozzle openings 14. Ink channels 15 lead from the ink tank 5 to these nozzle openings 14. These ink channels 15 are widened directly in front of the nozzle openings 14 into ink ejection chambers 16 in which there are drive elements 17 for ejecting ink droplets out of the nozzle openings 14. These drive elements 17 are, for example, heating resistors which are connected to operating contacts 18.

Figure 3:
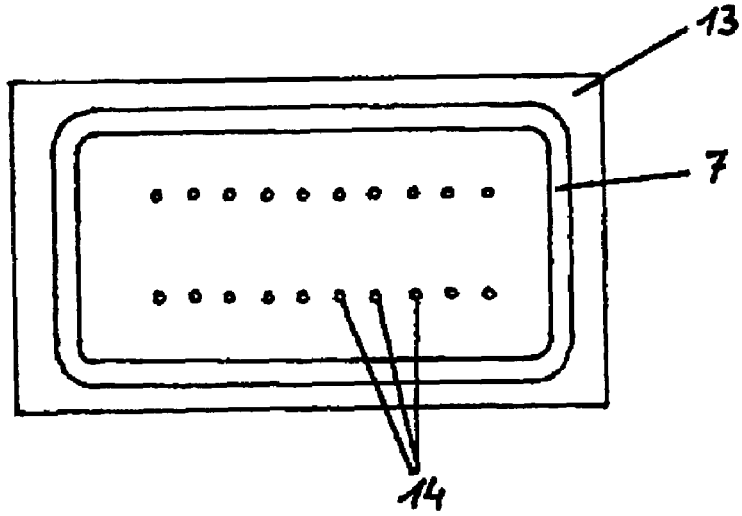
FIG. 3 shows view A—A as shown in FIG. 2.

FIGS. 2 and 3 clearly show how the seal 7, preferably an elastic sealing ring, adjoins and seals the nozzle plate 13 such that all nozzle openings 14 are fluidically coupled to the connecting openings 8.

The pump 9 can be switched between suction and pump operation. In suction operation the liquid in the ink tank—residual ink or cleaning liquid—can be sucked to the outside through the printing head 6. The liquid flows in the same direction in this flushing as the ink in the operation of a printer. In pump operation the cleaning liquid or ink is forced from the outside through the printing head 6 into the ink tank 5. This operation is called reverse flushing due to the reversed flow direction.

During flushing or reversed flushing the trigger device 12 delivers oscillating pulses or alternating voltage signals which are supplied to the drive elements 17 via the contact elements 11 and the operating contacts 18. The pulses or alternating voltage signals correspond essentially to the operating signals of an inkjet printer with respect to frequency and amplitude so that the corresponding pressure waves are excited in the nozzle openings 14 and the ink channels 15. In this way the cleaning action of flushing is increased. In the simplest case a printer on which the operating signals for the printing head 6 are tapped can be used as the trigger device 12.

What is claimed is:

1. A process for cleaning an inkjet printing head which has nozzle openings and ink channels which lead to them, in which electrical drive elements for ejecting ink out of the nozzle openings are located, in which the nozzle openings and the ink channels are forcibly flushed with a cleaning liquid, wherein the drive elements are triggered in an oscillating manner during the forced flushing with the cleaning liquid, wherein the drive elements are triggered phase-shifted.

2. The process as claimed in claim 1, wherein some of the majority of drive elements present in the printing head are triggered at one time.

3. The process as claimed in claim 1, wherein all the drive elements present in the printing head are triggered at the same time.

4. The process as claimed in claim 1, wherein the flow of cleaning liquid in forced flushing is directed from the outside of the nozzle openings to the inside through the ink channels.

5. The process as claimed in claim 1, wherein the flow of cleaning liquid in forced flushing is directed from the inside through the ink channels through the nozzle openings to the outside.

6. The process as claimed in claim 1, wherein the flow direction of the cleaning liquid in forced flushing is reversed.

7. The process as claimed in claim 1, wherein the drive elements are triggered essentially with the operating frequency and/or amplitude of the printing head in printing operation of an inkjet printer.

8. The device as claimed in claim 7, wherein the contact elements are connected to a signal generator.

9. The device as claimed in claim 7, wherein the contact elements are connected to a printer.

10. The device as claimed in claim 7, wherein the flushing device has a liquid pump.

11. The process as claimed in claim 1, wherein the drive elements are triggered with a frequency from roughly 5 to 20 kHz.

12. The process as claimed in claim 1, wherein ink is used as the cleaning liquid.

13. The process as claimed in claim 1, wherein the electrical operating parameters of the drive elements are measured during triggering.

14. A device for cleaning an inkjet printer head, with a holding device for the printing head, connecting means for liquid-tight coupling of a detergent line to the nozzle openings of a printing head which has been inserted into the holding device, and a flushing device for delivering the cleaning liquid to the detergent line, wherein the holding device comprises electrical contact elements which are connected to an electrical trigger device and make contact with electrical operating terminals of the printing head which has been inserted into the holding device.

* * * * *